US008857653B2

(12) United States Patent
Dawson

(10) Patent No.: US 8,857,653 B2
(45) **Date of Patent: *Oct. 14, 2014**

(54) PLATE WITH CUP ATTACHMENT

(71) Applicant: Michael T. Dawson, Fort Worth, TX (US)

(72) Inventor: Michael T. Dawson, Fort Worth, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/869,696

(22) Filed: Apr. 24, 2013

(65) Prior Publication Data

US 2013/0313264 A1 Nov. 28, 2013

Related U.S. Application Data

(63) Continuation of application No. 13/478,544, filed on May 23, 2012, now Pat. No. 8,444,001.

(51) Int. Cl.
*B65D 21/02* (2006.01)

(52) U.S. Cl.
USPC ..... 220/574; 220/23.86; 206/217; 206/549

(58) Field of Classification Search
USPC ..... 206/502, 217, 541, 549, 564, 223; 220/23.2, 23.4, 23.6, 759, 752, 574, 220/23.83, 575, 23.86, 379, 281, 282, 288, 220/480–482
See application file for complete search history.

(56) References Cited

U.S. PATENT DOCUMENTS

| | | | |
|---|---|---|---|
| 2,374,092 | A | 4/1945 | Glaser |
| 3,469,739 | A | 9/1969 | Warren |
| 5,058,737 | A | 10/1991 | Patterson et al. |
| 5,060,820 | A | 10/1991 | Boerner |
| 5,176,283 | A | 1/1993 | Patterson et al. |
| 5,240,136 | A | 8/1993 | Patterson et al. |
| 5,292,028 | A | 3/1994 | Patterson et al. |
| 5,301,833 | A | 4/1994 | Aycan |
| 5,325,962 | A | 7/1994 | Ouellette |
| 5,749,486 | A | 5/1998 | Porter |
| 5,954,195 | A | 9/1999 | Krueger et al. |

(Continued)

FOREIGN PATENT DOCUMENTS

FR 2 675 034 A1 10/1992

OTHER PUBLICATIONS

International Search Report and Written Opinion date mailed Jul. 25, 2013; PCT International Application No. PCT/US2013/037172.

*Primary Examiner* — Andrew Perreault
(74) *Attorney, Agent, or Firm* — R. Johnston Law, PLLC

(57) ABSTRACT

A dinner plate of conventional size and shape includes within its substantially planar bottom a coaxial central region having coupling means in the form of diametrically opposing, chordal grooves that mate with the outwardly curled rim of commonly available, flexible plastic drink cups. The coupling means holds the cup snugly against the bottom of the plate, enabling a user confidently to hold both in one hand, freeing his other hand and allowing considerable acentric loading of the plate with foods. Inserting the cup rim into the grooves requires squeezing it slightly and temporarily into an oval shape. Once released, the cup's resiliency enhances the snugness of the fit and the security of the coupling. In a preferred embodiment, the central region forms a slightly raised island in the center of the plate, the island creating a recess substantially flush with the bottom of the plate, thereby abetting use of the plates on horizontal surfaces and optimizing the nesting of multiple plates for storage and stacking. Segments of the walls of the recess include radially inward-extending lugs that fit under the cup rim and secure it against the bottom surface of the recess.

21 Claims, 7 Drawing Sheets

(56) References Cited

U.S. PATENT DOCUMENTS

| | | | |
|---|---|---|---|
| 6,021,903 | A | 2/2000 | Hanson |
| 6,138,860 | A | 10/2000 | Comeaux |
| 6,338,417 | B1 | 1/2002 | Ferraro |
| 6,732,990 | B2 | 5/2004 | Hudson |
| 7,115,294 | B1 | 10/2006 | Loh et al. |
| D557,072 | S | 12/2007 | Lim |
| 2004/0238537 | A1 | 12/2004 | Ojeda |
| 2007/0264167 | A1 | 11/2007 | Warner |
| 2008/0142528 | A1 | 6/2008 | Lim |
| 2008/0257895 | A1 | 10/2008 | Broselow |

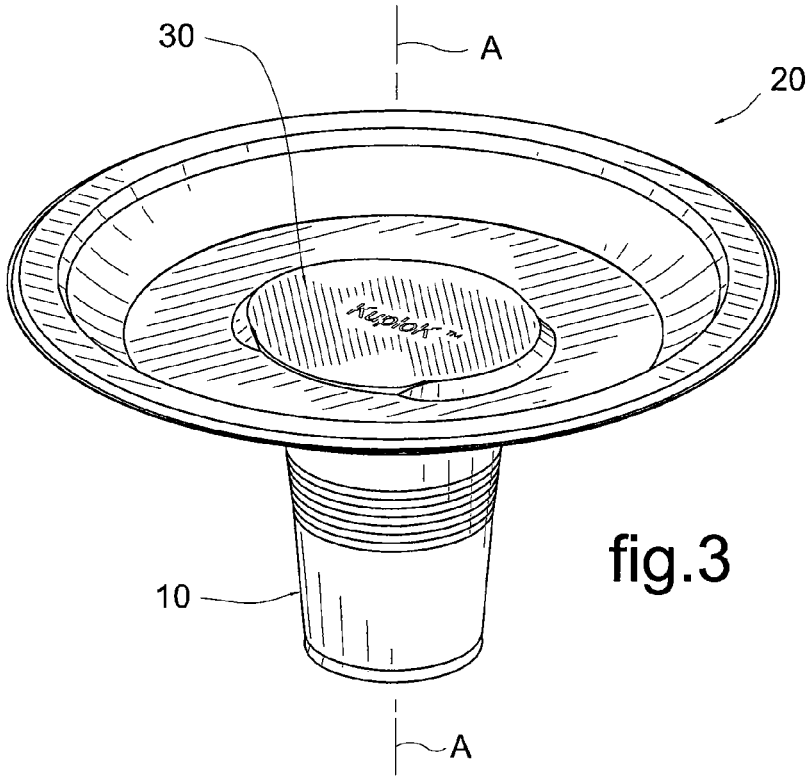
fig.3
fig.4
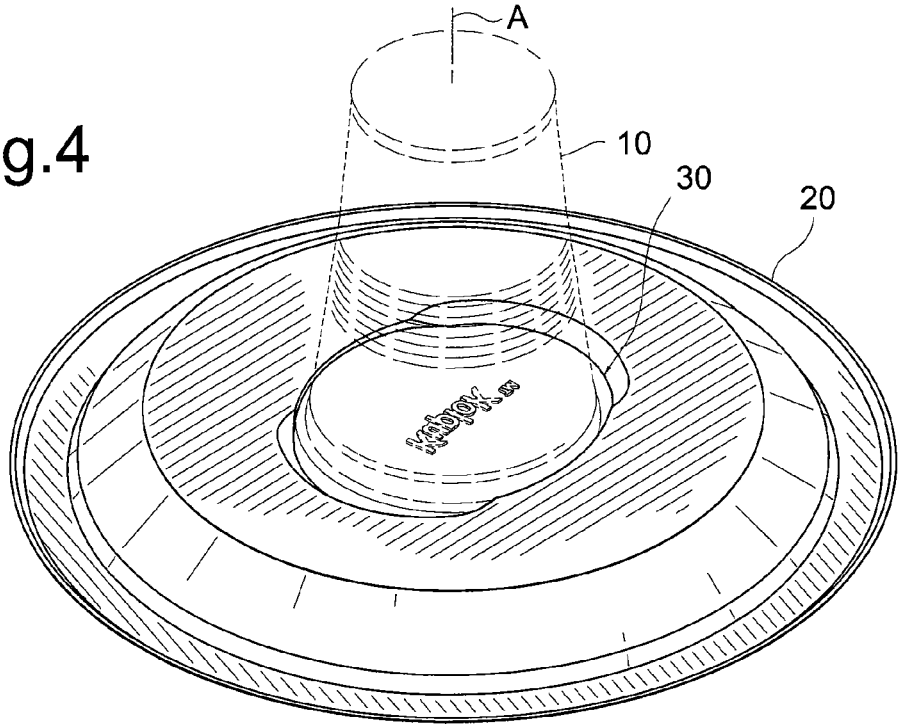

PLATE WITH CUP ATTACHMENT

CROSS-REFERENCE TO RELATED APPLICATIONS

This application is a continuation of U.S. patent application Ser. No. 13/478,544 filed on May 23, 2012, entitled PLATE WITH CUP ATTACHMENT, which is incorporated herein by reference for all purposes.

BACKGROUND OF THE INVENTION

1. Field of the Invention

This invention relates generally to dishware and particularly to disposable or durable dishware used in dinner party and buffet settings. More particularly, this invention relates to a plate or other flat dishware bearing coupling means on its underside adapted to couple to the rim of a flexible, disposable drink cup.

2. Description of Related Art

Party goers and buffet diners alike are familiar with the common conundrum of not having enough hands to eat and drink from their food plates and drink cups without a place to set down one or the other. In typical party settings, revelers often snack or even eat while standing and talking to others. In buffet lines, diners must move along a table gathering food choices onto their plate but seldom have a place to set their drink while they do so. Such party goers and diners may become adept at holding their cups and plates in one hand while wielding forks or serving utensils in the other. However, mastering such gymnastics isn't easy, especially for children, and just setting a loaded plate on top of a drink cup invites accidents. A need exists for plates that couple securely to drink containers to free one hand for other activities.

A number of prior art devices have been developed to address this problem. One common approach comprises plates with a scallop in one edge for inserting stem-ware such as a wine glass. Others include annular collars or other appendages extending downward from the bottom of plates that fit over the rim of a cup or glass. Still others include bayonet-like appendages on specialized cups that mate with complimentary apertures on the bottom of specialized plates. Another approach is to provide special plate-and-cup holders that couple to both containers. All of these work to some degree but present various challenges and inconveniences.

For example, most discourage or even prevent use of commonly available, inexpensive and disposable dishware, and instead require more expensive proprietary cups and plates designed only to work together. Scalloped-edge plates are relatively expensive to manufacture, and the system typically works only with stem-ware, as the aperture usually is kept small to preserve space on the top of the plate for holding food. Descending-collar devices interfere with resting the plate on a table or other horizontal surface. Further, the collar-to-cup interface may be a loose fit that invites tipping of the plate from acentric food loading unless it is secured by vigilant grasp by the user. The bayonet and aperture system is expensive and doesn't permit use of alternative cups and plates. The plate-and-cup holder devices often work with commonly available dinner plates and drink containers, but require the expense and use of a third device. A need exists for a simple plate that couples to ordinary, commonly available plastic drink cups so that both may be held in one hand, freeing the other hand for eating, serving or other activities.

SUMMARY OF THE INVENTION

A dinner plate of conventional size and shape includes within its substantially planar bottom a coaxial central region having coupling means in the form of diametrically opposing, chordal grooves that mate with the outwardly curled rim of commonly available, flexible plastic drink cups. The coupling means holds the cup snugly against the bottom of the plate, enabling a user confidently to hold both in one hand, freeing his other hand and allowing considerable acentric loading of the plate with foods. Inserting the cup rim into the grooves requires squeezing it slightly and temporarily into an oval shape. Once released, the cup's resiliency enhances the snugness of the fit and the security of the coupling. In a preferred embodiment, the central region forms a slightly raised island in the center of the plate, the island creating a recess substantially flush with the bottom of the plate, thereby abetting use of the plates on horizontal surfaces and optimizing the nesting of multiple plates for storage and stacking. Segments of the walls of the recess include radially inward-extending lugs that fit under the cup rim and secure it against the bottom surface of the recess.

BRIEF DESCRIPTION OF THE DRAWINGS

The novel features believed characteristic of the present invention may be set forth in appended claims. The invention itself, however, as well as a preferred mode of use and further objects and advantages thereof, will best be understood by reference to the following detailed description of an illustrative embodiment when read in conjunction with the accompanying drawings, wherein:

FIGS. 3-4 show in top- and bottom-quartering perspectives the plate of FIG. 2 mated to an ordinary, frustro-conical plastic drinking cup.

DESCRIPTION OF A PREFERRED EMBODIMENT

Figure 1:
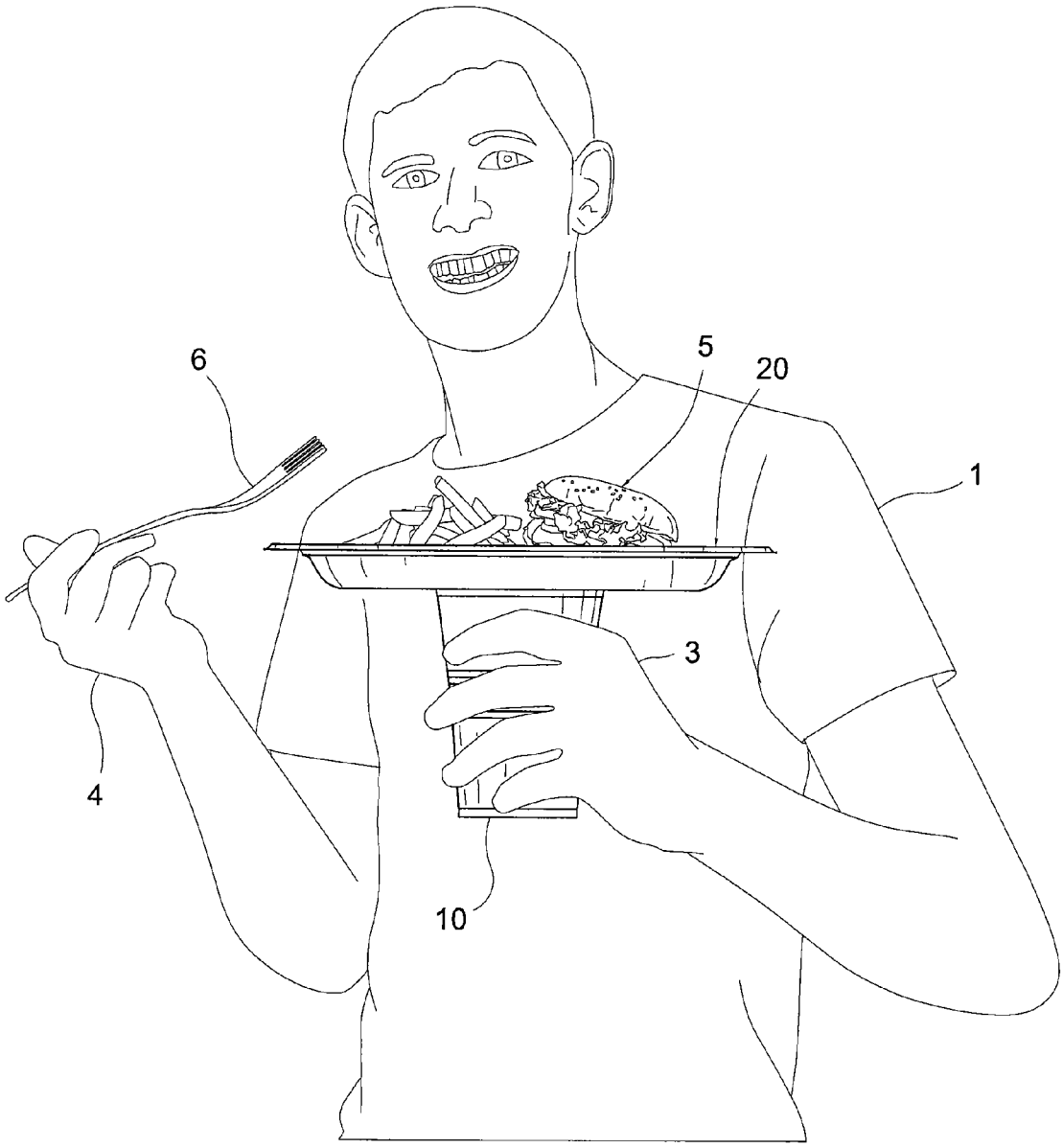
FIG. 1 shows a party goer holding the present invention in one hand while using his free other hand to eat.
Figure 2:
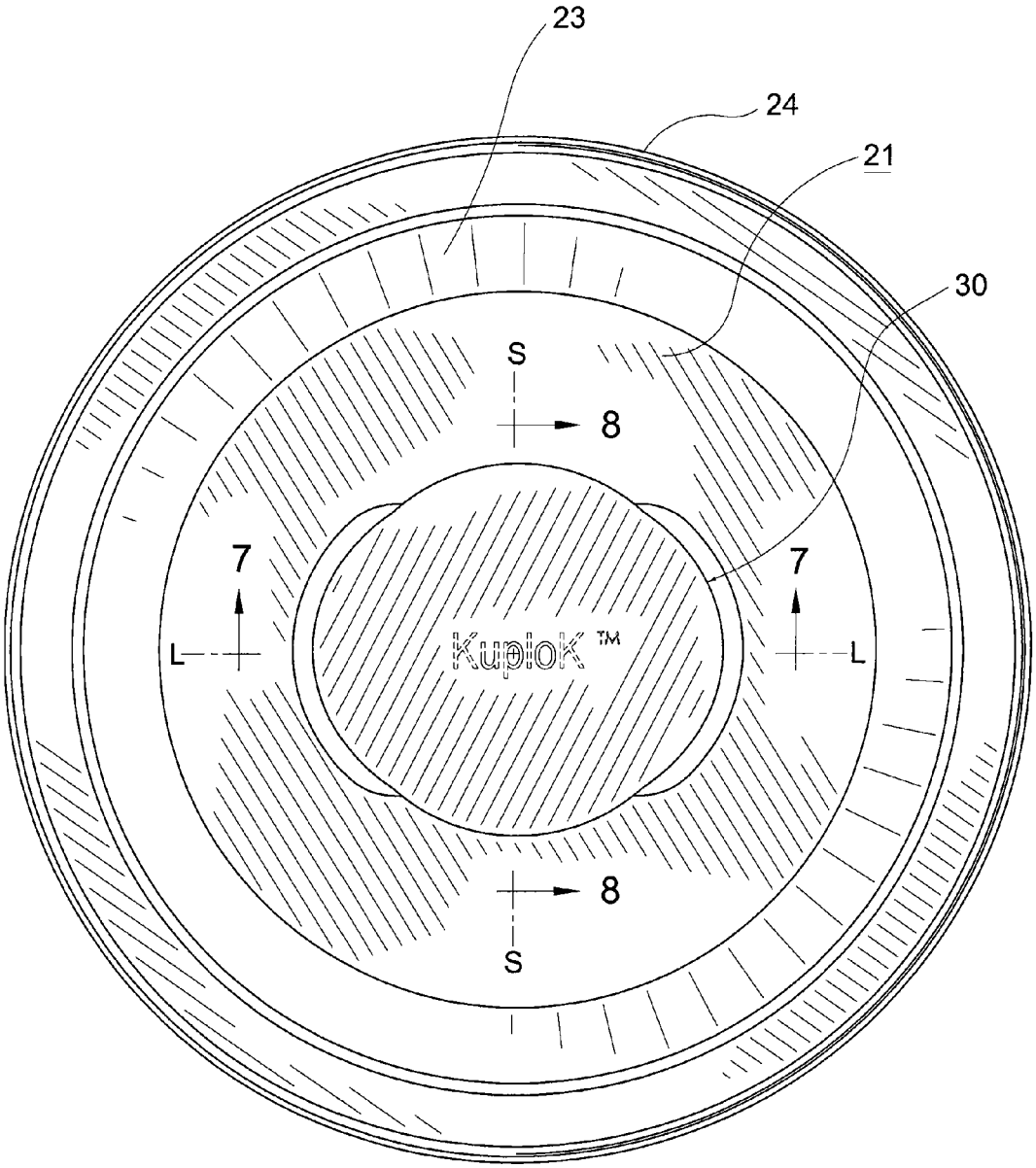
FIG. 2 shows in top plan view a plate embodying a preferred embodiment of the present invention.

Referring now to the figures, and particularly to FIG. 1, user 1 employs the present invention to hold his plate 20 containing food 5 by grasping his drink cup 10 with one hand 3. Because plate 20 is coupled to the rim of cup 10, user 1's other hand 4 is free to handle his fork 6 or to perform other tasks without putting down his food plate 20 and drink cup 10.

Referring now also to FIGS. 2-5, cup 10 comprises a ubiquitous, inexpensive drink container commonly found in party supply stores. Cup 10 has a generally frustro-conical shape with a wide, circular mouth 13 and regular, conical walls 12 tapering toward and truncated by a narrower bottom 11. Cup walls 12 surround and define interior 14 in which typically is held a liquid beverage (not shown), often at an elevation within interior 14 close to mouth 13. Surrounding mouth 13, outwardly curled rim 15 comprises a continuation of walls 12 to form a smooth lip engaged by user 1's mouth while he drinks the contents of cup 10. Cup 10 may include grasping grooves 16 and other non-essential features such as logos and decorations (not shown) on the outside of walls 12. Cup 10 typically is made of polystyrene plastic thermoformed into the indicated shape. Cup 10 typically is geometrically stable, though flexible enough to bend and deform, as will be discussed below. One having ordinary skill in the art will recognize that other drink containers can serve equally well as cup 10 as long as they embody two traits: (1) their mouth 13 and rim 15 include a diameter substantially equivalent to dimension C (see FIG. 5) of coupling means 30 of the present invention; and (2) rim 15 and mouth 13 are sufficiently flexible and resilient that they may be deformed temporarily to the size of dimension D for insertion into coupling means 30, as discussed in detail below.

Plate 20 shares most of its features with the likewise ubiquitous party plates used in various sizes and materials by the millions annually. Plate 20 includes a substantially planar bottom having a bottom surface 21 opposite and substantially coextensive with top surface 22. Surrounding the plate bottom, shallow side walls 23 rise to a wider plate brim 24 to form a convenient, substantially open and planar container, typically intended to hold food 5 portions while user 1 enjoys eating them. Usually rested on a table or other horizontal surface, but not uncommonly held in one hand by user 1, plate 20 may be loaded on different parts of its top surface 22 with foods 5 or other objects of different densities and weights. Plate 20 thereby often becomes acentrically loaded about its vertical axis A (see FIGS. 3 and 4) This acentric loading usually presents no problem for user 1, however, because he either grasps sides 23 and brim 24 (not shown) firmly to resist the overturning effect of acentric loading, or he places plate 20 onto a horizontal surface such as a table (not shown). If user 1 has a drink in cup 10 while he eats, he usually must set cup 10 aside and hold plate 20 with one hand 3 while he eats with his other hand 3.

Coaxial with sides 23 in the center of bottom 21, 22 of plate 20, coupling means 30 permits user 1 to hold his cup 10 and plate 20 simultaneously in one hand without fear of plate 20 tipping and falling. Coupling means 30 includes on bottom 21 of plate 20 a plurality of rim grasping means adapted to surround a portion of rim 15 and to hold mouth 13 against bottom 21. This permits user 1 to deviate considerably from holding plate 20 directly upright, as long as he doesn't do so enough that food 5 becomes disengaged from plate 20. As depicted in FIG. 1, a preferred and natural manner of holding plate 20 and cup 10 simultaneously would be by gripping cup 10 in a comfortable, conventionally upright grasp. One having ordinary skill in the art will recognize, of course, that alternately user 1 could grasp plate 20 by sides 23 and brim 24 while cup 10 remains securely suspended beneath bottom 21, 22 within coupling means 30.

In a preferred embodiment, as seen also in FIGS. 6-10, coupling means 30 comprises a raised, lid portion 31 of bottom 21, 22, essentially a low, planar "island" in the middle of plate 20 surrounding axis A. Lid portion 31 surrounds and defines a shallow, oval recess 35 within bottom surface 21 just deep enough that rim 15 may be inserted. Lid portion 31's substantially oval or elliptical shape includes short axis S, along which Section 7-7 is indicated, and long axis L, along which Section 8-8 is indicated, in FIG. 2. Lid portion 31 lies in a plane substantially parallel to the plane of plate bottom 21, 22 and offset vertically thereabove by a distance substantially equivalent to the diameter of curled rim 15 of cup 10.

Figure 10:
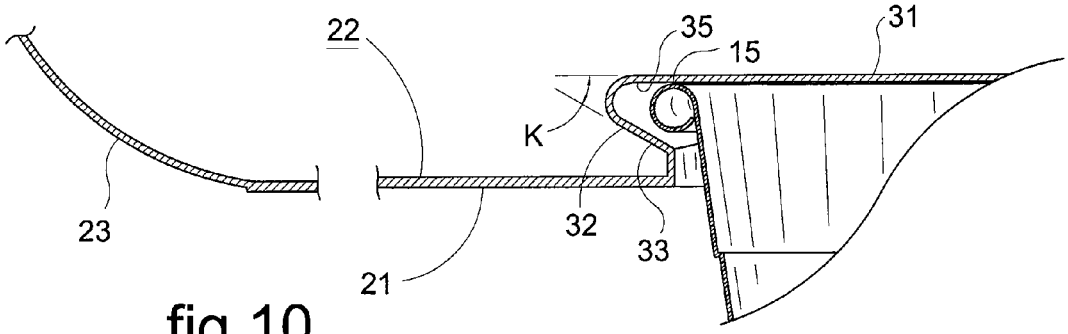
FIG. 10 details the fit of the rim of the cup into the chordal groove portion of the preferred embodiment of the present invention.

Descending between the planes of lid portion 31 and plate bottom 21, 22, recess walls 32 define the perimeter of recess 35. Formed within a chordal segment of recess walls 32 and symmetric on either side of short axis S, a pair of opposing cup rim grasping zones comprise segments of walls 32 that extend radially inward toward axis A to form rim retaining lugs 33 that terminate in noses 34 adapted to extend beneath rim 15 to a position adjacent cup walls 12. Lugs 33 thus form a groove between the bottom of lid portion 31 and nose 34 into which rim 15 reaches while engaged within recess 35. As best seen in FIG. 10, lugs 33 preferably extend at an acute angle K to lid portion 31. Preferably, angle K is between twenty (20 deg.) degrees and forty-five (45 deg.) degrees, and more preferably approximately thirty (30 deg.) degrees, but one having ordinary skill in the art will recognize that almost any angle that results in dimension D, the distance between noses 34 (FIG. 5), being shorter than dimension C (the maximum diameter of coupling means 30 adjacent lid portion 30) is considered to be within the spirit and scope of the present invention. The preferred angle K discussed above abets fabrication of plate 20 using fixed thermoform molds, as discussed in more detail below.

Lugs 33 preferably engage rim 15 along its circumference in at least four places spaced around rim 15. The chordal segments of recess walls 32 defined by lugs 33 have substantially consistent radii, making them substantially circular segments. This in turn causes the grooves formed by lugs 33 to surround corresponding chordal segments of rim 15. Further, the diametrical separation of lugs 33 preferably and advantageously is slightly less than the diameter of rim 15. Thus, the resiliency of cup 10 urges rim 15 firmly beneath lugs 33 and lends a significant friction-inducing forced fit between cup 10 and plate 20 within recess 35.

Preferably, rim 15 substantially, though not entirely, expands to match the radii of lugs 33. Because its radius preferably is slightly greater than the radii of lugs 33, rim 15 actually engages recess 35 more tightly the ends of the chordal segments of lugs 33 than at their central portions juxtaposed short axis S. This actually further enhances the snugness of the grasp of rim 15 by lugs 33. The expansive resiliency of cup 10 thereby forces rim 15 against lugs 33 the four distinct end points of the chordal segments formed by lugs 33 instead of spreading that force over the entire arc of lugs 33. This in turn holds cup 10 more tightly and better resists moment forces that try to overturn plate 20. One having ordinary skill in the art will recognize, however, that, though substantially standardized for consistency and convenience in use in the party supplies industry, the diameter of rim 15 may vary slightly from one cup 10 to another, and the moment resistance created by lugs 33 may be more evenly distributed along lugs 33 for one cup 10 while for another cup 10 it is concentrated at the endpoints of the chordal segments defined by lugs 33.

The chordal segments of lugs 33 preferably comprise no more than half the perimeter of recess 35, and they correspondingly engage no more than half the circumference of rim 15. One having ordinary skill in the art will recognize that the length of said chordal segments is not critical as long as the ends of lugs 33 distal short axis S that engage rim 15 the tightest are angularly separated enough that they provide sufficient moment resistance to overcome forces tending to tip plate 20 and to disengage rim 15 from recess 35. Preferably, the opposite ends of said chordal segments formed by lugs 33 are separated by no less than thirty (30) degrees of arc, and no more than forty-five (45 deg.) of arc, about axis A.

Figure 6:
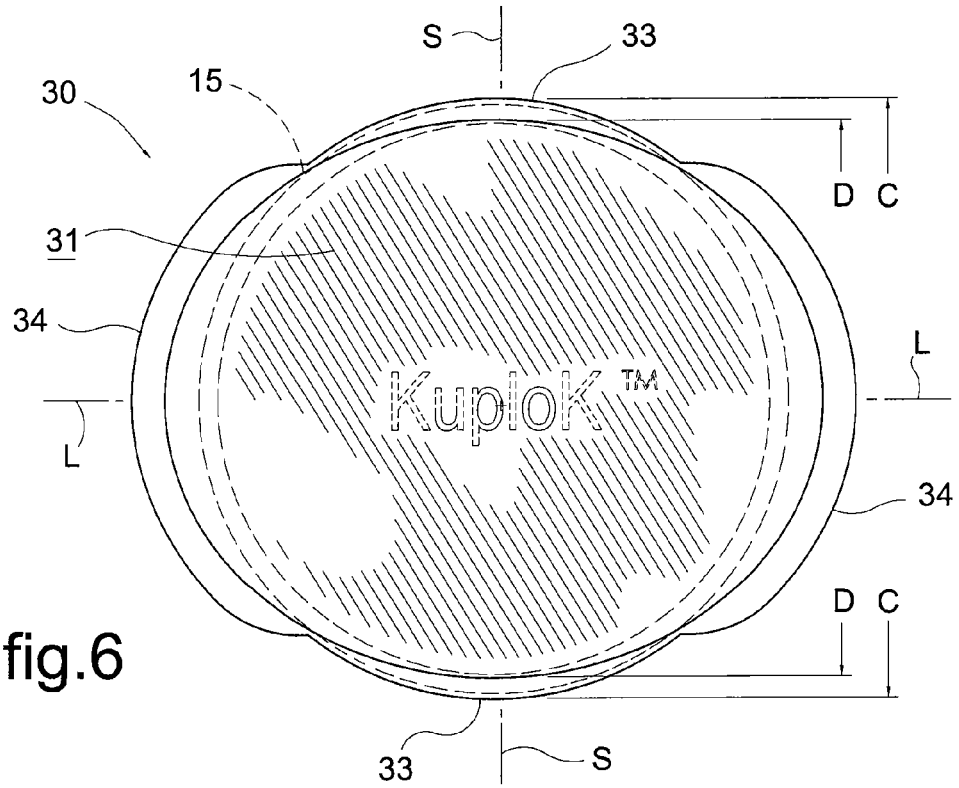
FIGS. 6-7 show in top plan view a plate's central region embodying the preferred embodiment of FIG. 2, the rim of a cup being visible in hidden line representation and illustrating its deformation while being mated with the coupling means of the present invention.
Figure 7:
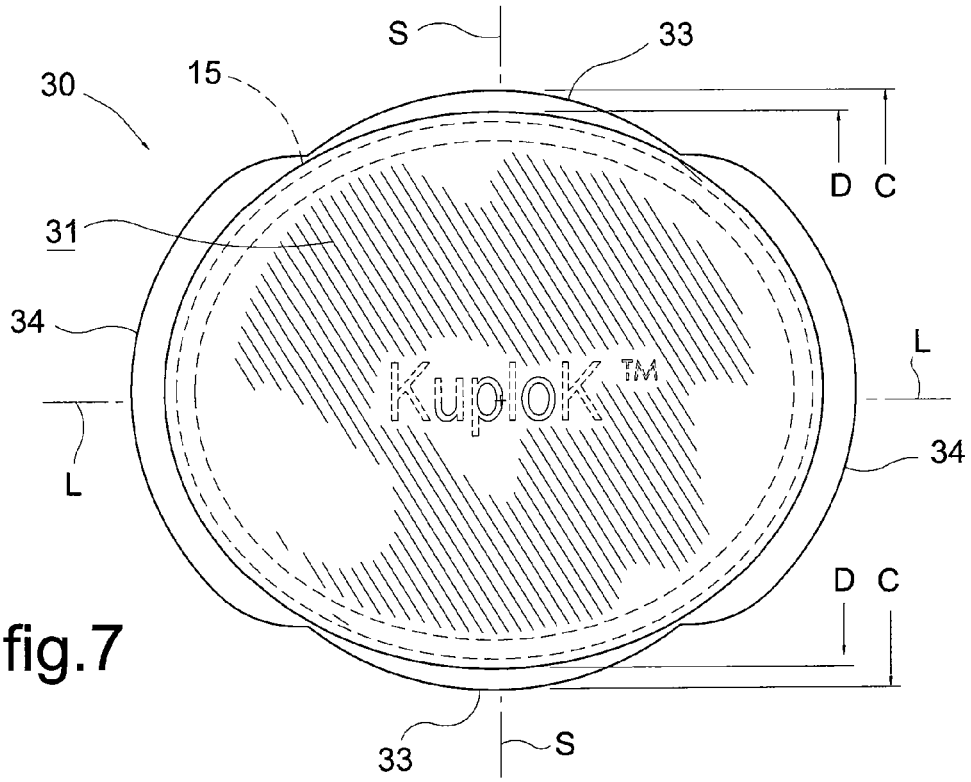
Figure 8:
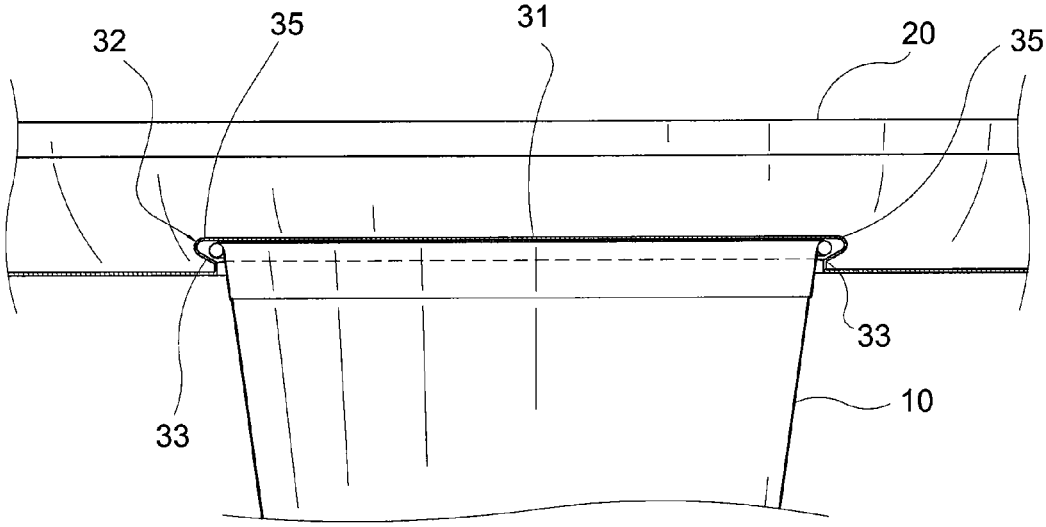
FIGS. 8-9 correspond to FIGS. 6 & 7 respectively and depict in side elevational section views as indicated in FIG. 2 the cup rim positioned into different portions of the recess of the preferred embodiment of FIG. 2.
Figure 9:
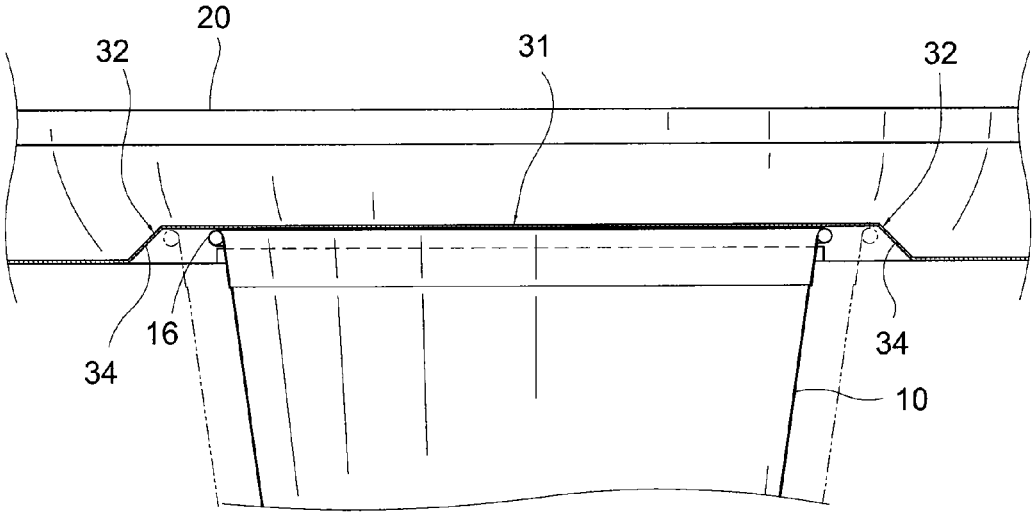

Along the remaining portions of the perimeter of recess 35, essentially two other chordal segments thereof disposed symmetrically on either side of long axis L, recess walls 32 deviate radially outward from axis A toward plate side walls 23. This forms a pair of opposing expansion zones 36 into which rim 15 may stretch while being inserted into recess 35. As best seen in FIG. 6, expansion zones 36 extend along long axis L such that the planar surface of the bottom of lid portion 31 within recess 35 exceeds the diameter of rim 15 substantially. Further, walls 32 in this region also slope radially outward away from axis A, preventing walls 32 from interfering with cup 10 as rim 15 is inserted into recess 35.

Figure 5:
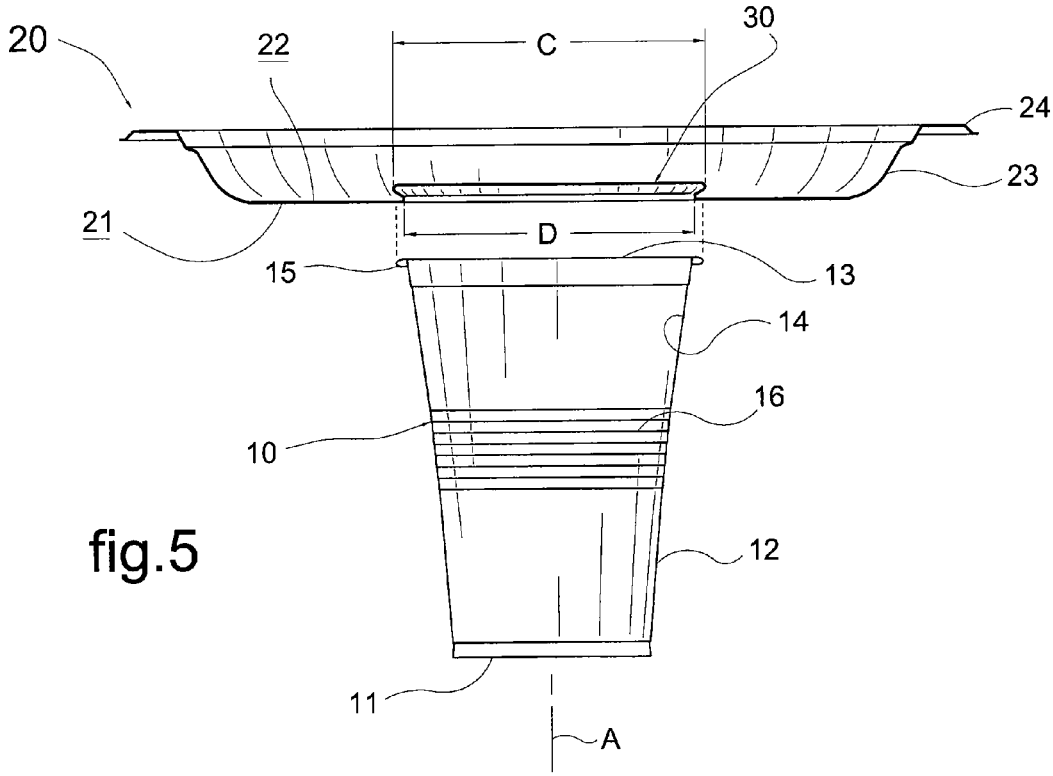
FIG. 5 details in side elevational view the comparative diameters of the cup rim and the recess coupling means of the preferred embodiment of FIG. 2.

In operation, user 1 grasps in one hand plate 20 and aligns cup 10 with axis A beneath recess 35 (see FIG. 5). User 1 then squeezes rim 15 into an oval shape with its resulting short axis parallel to axis S of recess 35 while urging cup 10 toward lid portion 31. As long as user 1 squeezes rim 15 enough that its short axis is no greater than dimension D, and positions its long axis substantially parallel to long axis L of recess 35, rim 15 will enter recess 35. Once rim 15 abuts lid portion 31, user 1 relaxes his squeezing grasp of rim 15 and allows it to expand beneath lugs 33. Cup 10 then is coupled to plate 20 securely enough that it will not fall out if user 1 releases his grasp on it altogether and hold both plate 20 and cup 10 with his other hand by plate sides 23. To remove rim 15 from recess 35, user 1 may simply pull it away from lid portion 31 and parallel axis A until it pops out, or he may squeeze rim 15 again until he can remove it more gently.

The above insertion procedure of rim 15 into recess 35 presumes substantial alignment of cup 10 with axis A, which user 1 may learn to do with practice. But even with less than perfect alignment, user 1 can insert cup 10 into recess 35 without looking beneath plate 20, and with very little practice. First, user 1 urges a first edge of rim 15, say adjacent his fingers, into substantial engagement with a first lug 33 on one side of bottom 21 of plate 20. This can be confirmed simply by rotating plate 20 slightly and feeling the ends of said first lug 33 against rim 15. Next, user 1 can look at the top of plate 20 and orient lid portion 31 so that its side opposite where he knows rim 15 already resides is directly above his thumb. To facilitate this step, he can place his thumb slightly above rim 15 so he can feel bottom surface 21 of plate 20 as he proceeds. Then, he simply squeezes rim 15 gently with his thumb while simultaneously urging the side of rim 15 adjacent his thumb toward lid portion 31 until he feels rim 15 slip into recess 15 and abut lid portion 15. Even if the resulting long axis of rim 15 is not perfectly aligned with long axis L of recess 15, when user 1 relaxes his squeezing of rim 15, it will expand and settle into the grooves formed by lugs 33 without user 1 having to consciously make it do so. To test for a successful coupling, he may tug slightly on cup 10 parallel to axis A and then turn his attention to other matters.

Figure 11:
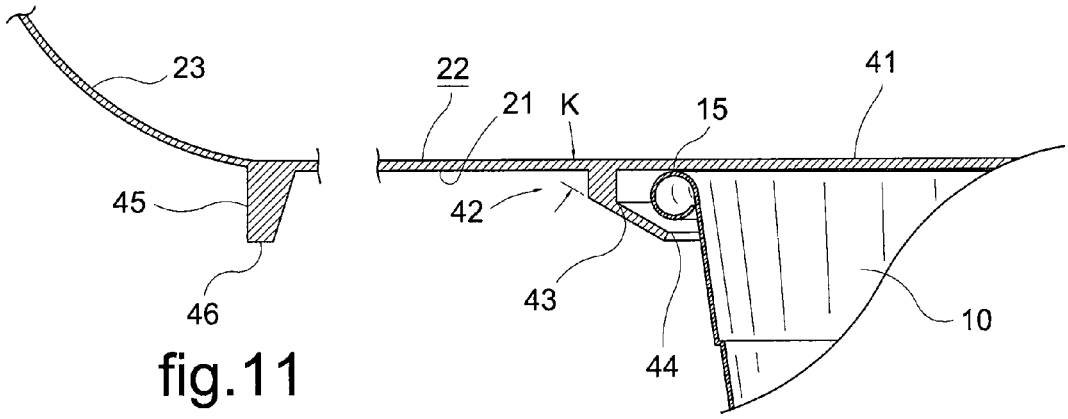
FIGS. 11-12 detail alternate embodiments to the recessed chordal grooves of the preferred embodiment of the present invention.
Figure 12:
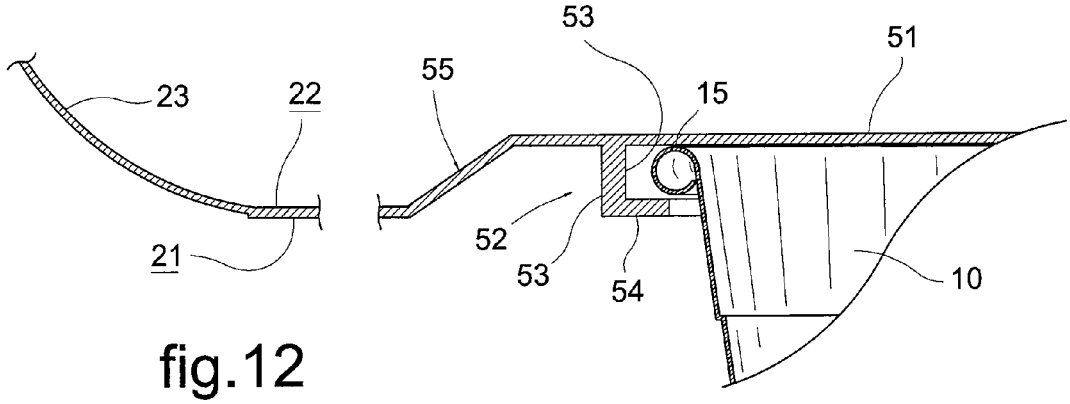

Turning next to FIGS. 11-12, alternate embodiments of the present invention appear. In FIG. 11, no recess 35 exists, and lugs 43 simply descend directly from bottom 21 of plate 20. They then turn radially inward and angle downward toward axis A to terminate in noses 44 that reach beneath rim 15 to enclose and grasp it. The angle K from lid portion 41 at which lugs 43 descend preferably is the same as described above for lugs 33 of the preferred embodiment. Further, lugs 43 extend in chordal segments (not shown) along bottom 21 substantially the same length and position as do the chordal segments defined by lugs 33 as discussed above for the preferred embodiment. Lugs 43 thereby serve the same purpose and function similarly to lugs 33, but without deforming top surface 22 of plate 20. The "expansion zone" for the temporary long axis of rim 15 comprises the entire bottom 21 of plate 20 outside of the reach of lugs 43.

Since lugs 43 are not recessed into bottom 21, however, they could interfere with using plate 20 on a flat surface such as a table. To overcome this potential problem, an annular plate resting region surrounds coupling means 30 to hold a substantial portion of the weight of plate 20 burdened with food 5. In this embodiment, such annular plate resting region comprises rails 45 descending substantially normal to plate bottom 21 and terminating in heels 46 separated substantially the same distance from bottom 21 as noses 44 of lugs 43. Rails 45 thus engage any horizontal surface onto which plate 20 is placed and provide a full resting surface for plate 20 that prevents it from becoming unstable.

Preferably, rails 45 comprise an annular ridge surrounding entirely bottom 21 of plate 20 juxtaposed plate sides 23. One having ordinary skill in the art will recognize, however, that rails 45 may comprise only chordal segments of such an annular ridge, or may comprise very short segments thereof between which gaps may exist, as long as the segments are distributed around the perimeter of plate 20. One having ordinary skill in the art will recognize, too, that the radial displacement from axis A of rails 45, and the number of concentrically arrayed rails 45 employed, may vary without departing from the spirit and scope of the present invention.

In FIG. 12, an alternate shape for lugs 43 is displayed. Instead of descending only a portion of the diameter of rim 15 and then turning to angle radially inward toward axis A (as in FIG. 10), lug 53 comprises a rectangular in shape. Lug 53 descends normal to bottom 21 the full diameter of rim 15 and then turns perpendicularly inward toward axis A and cup walls 12, thereby forming flange 54 having a substantially flat lower surface on which plate 20 can rest when placed onto a horizontal surface. In cooperation with rail 45, this configuration may provide a more stable inner support for plate 20 than lugs 43. One having ordinary skill in the art will recognize that other shapes for lugs 33, 43, 53 may be employed without departing from the spirit and scope of the present invention.

Also referring to FIG. 12, another alternate embodiment of the present invention does not rely upon rails 45. In their place, the annular plate resting region comprises a portion of bottom 21, 22 of plate 20 surrounding lid portion 51, separated therefrom by bevel 55. This results in most of bottom 21, 22 having substantially the same vertical displacement below lid portion 51 as does flange 54. Instead of plate 20 in this embodiment having distinct rails 45, the same purpose is served by simply forming plate bottom 21, 22 to become an annular plate resting region shaped as a trough surrounding lid portion 51.

One having ordinary skill in the art will recognize that the portion of plate bottom 21, 22 surrounded by the trough effectively becomes another recess, less distinctly defined as recess 35, within which the present invention is disposed. This is especially true if bevel 55 is close to lugs 53 and steep enough that the greatest portion of bottom 21, 22 of plate 20 is displaced to the level of flange 54. One having ordinary skill in the art will recognize, too, that variations in this configuration, such as narrow versus wide troughs, and segmented troughs that together surround central portion 51 but which also are separated from each other by baffles (not shown), are possible alternative configurations, and that all such variations fall within the spirit and scope of the present invention.

Preferably, plate 20 embodying the preferred embodiment or any alternate embodiments, is fabricated using thermoform molding techniques and made from one of a number of possible thermoplastic hydrocarbons such as polyethylene or polystyrene that permit the use of fixed molds to form recess 35 and lugs 33, 43, 53. One having ordinary skill in the art will recognize, however, that in some party or dinner settings, a more rigid and higher quality plate 20 may be desirable. In such case, plate 20 may be made of one of a number of possible thermoset hydrocarbons such as polystyrene, and formed in injection molds that can form more rigid lugs 33, 43, 53.

The present invention, as shown and described, provides an apparatus and method for improving serving dishes in, among other things, party and buffet settings. Employing plate 20 embodying the present invention, user 1 confidently may carry his plate of food around in one hand 3 at a party venue, with plate 20 securely coupled to rim 15 of cup 10 by lugs 33, 43, 53, without risk of spilling its contents because he failed to maintain sufficient vigilance and plate 20 tipped over. Should another user (not shown) accidentally bump user 1's arm 3, plate 20 is unlikely to fall. Further, user 1 may periodically employ his opposite hand to grasp plate 20 while he squeezes rim 15 of cup 10 gently and disengages it from lugs 33, 43, 53 long enough to take a drink or refill it and then return it to positive engagement with lugs 33, 43, 53.

While the invention has been particularly shown and described with reference to preferred and alternate embodiments, it will be understood by those skilled in the art that various changes in form and detail may be made therein without departing from the spirit and scope of the invention. For example, plate 20 has been described as being fabricated from a geometrically stable but flexible plastic material easily formed using fixed thermoform molds. Plate 20 could, however, be fabricated from paper, glass or other materials, with concomitant changes (such as movable parts) in the molds by which it is formed.

Further, cup 10 has been depicted and discussed as having an outwardly curled rim 15 having a substantially circular, vertical cross section. Cup 10 instead could be rimless and still fit snugly between lugs 33, 43, 53 and function similarly. Where this is the case, lugs 33, 43 could be shaped so that their radially inward descent is at an angle that closely matches the conical taper of sides 12 of cup 10.

Still further, plate 20 need not be circular, but could have other shapes, and coupling means 30 could be offset to one side or a corner (none shown). Further yet, coupling means 30 may be provided on other dishware, such as bowls, saucers or serving trays (none shown) instead of just plates 20. Further still, though the invention has been discussed in the context of dishware bearing food cargo, coupling means 30 could be incorporated into other containers for other applications, such as a caddy for gathering small objects from bins in a warehouse.

Finally, one having ordinary skill in the art will recognize that plate 20 effectively comprises a lid, cap or other closure for cup 10, securing the contents of interior 14 that otherwise is open at the top through mouth 13. Thus, the size and shape of plate 20 could be modified in furtherance of this cup 10 closure function and less resemble a food plate. Still, it could provide a tray-like function for placing small objects or utensils on top of cup 10.

I claim:

1. A plate having a top side and a bottom side, the plate for releasably coupling to a flexible cup having a rim on a circular mouth, the circular mouth having a mouth diameter, the plate comprising:

a body having shallow side walls oriented away from the bottom side to form a container for holding objects on the top side;

a planar island formed proximate a middle of the plate, the planar island forming a recess on the bottom side of the plate;

the recess on the bottom side of the plate formed with perimeter walls having an ovate perimeter and having a long axis and a short axis, wherein the long axis and short axis cross at substantially a ninety degree angle to one another proximate the middle of the plate, and wherein the perimeter walls surround the perimeter;

a plurality of retaining lugs formed on the perimeter walls proximate to the short axis of the recess, wherein the lugs are sized and configured to extend beneath the rim of the cup when the cup is in a coupled position; and wherein the perimeter walls further comprise:

a first portion of the perimeter walls at one end of the long axis of the recess, wherein the first portion includes the perimeter wall extending outwardly from the middle of the plate and thereby forming a first expansion zone on the bottom side, a second portion of the perimeter walls at the other end of the long axis of the recess, wherein the second portion includes the perimeter wall extending outward from the middle of the plate and thereby forming a second expansion zone on the bottom side, and wherein the first expansion zone and second expansion zone are sized and configured to receive portions of the rim of the cup when the cup is placed in a squeezed position for loading.

2. The plate of claim 1, wherein the flexible cup is formed from polystyrene.

3. The plate of claim 1, wherein the planar island has a flat portion in a first plane and the bottom side of the plate is substantially in a second plane, and wherein the first plane and second plane are parallel and offset from one another by a distance substantially equivalent to a diameter of the rim of the cup.

4. The plate of claim 1, wherein the plurality of retaining lugs comprise a portion of the perimeter walls turned to angle toward the middle of the plate.

5. The plate of claim 1, wherein the plurality of retaining lugs comprise a portion of the perimeter walls turned to angle toward the middle of the plate and wherein the portion of the wall turned to angle toward the middle terminates in noses adapted to extend beneath the rim.

6. The plate of claim 1, wherein a radius of the perimeter walls proximate the short axis is less than a radius of the circular mouth of the flexible cup when the flexible cup is in the coupled position.

7. The plate of claim 1, wherein the plurality of lugs form an acute angle K between the lugs and the planar island, and wherein K is between 20 degrees and forty-five degrees.

8. A method of releaseably coupling a plate having a top side and a bottom side to a flexible cup having a rim on a circular mouth, the method comprising the steps of:

providing the plate, wherein the plate comprises:

a material forming a circular body having shallow surface walls oriented away from the bottom side to form a container for holding objects on the top side, a planar island formed proximate a middle of the plate, the planar island forming a recess on the bottom side of the plate, the recess on the bottom side of the plate formed with perimeter walls having an oval perimeter and having a recess long axis and a recess short axis, wherein the recess long axis and recess short axis cross at substantially a ninety degree angle to one another proximate the middle of the plate, a plurality of retaining lugs formed on the perimeter walls proximate to the recess short axis, wherein the lugs are sized and configured to extend beneath the rim of the cup when the cup is in a coupled position, and wherein the perimeter walls further comprises:

a first portion of the perimeter walls at one end of the recess long axis, wherein the first portion includes the perimeter wall extending outwardly from the middle of the plate and thereby forming a first expansion zone on the bottom side, a second portion of the perimeter walls at the other end of the recess long axis of the recess, wherein the second portion includes the perimeter wall extending outward from the middle of the plate and thereby forming a second expansion zone on the bottom side, and wherein the first expansion zone and second expansion zone are sized and configured to receive portions of the rim of the cup when the cup is placed in a squeezed position for loading;

squeezing the rim of the flexible drinking cup such that the circular mouth assumes an oval shape and thus has a cup short axis and a cup long axis and so that a distance across the rim of the flexible drink cup along the cup short axis is less than the distance across the recess short axis on the bottom side along the recess short axis and wherein the distance across the rim of the flexible drinking cup along the cup long axis is less than distance across the recess on the bottom side along the recess long axis;

positioning the rim within the recess; and un-squeezing the rim of the flexible drinking cup such that the flexible drinking cup assumes a coupled position in which the mouth of the flexible drinking cup has resumed the circular shape and the plurality of retainer lugs engage the rim.

9. The method of claim 8, wherein when the flexible drinking cup is in the coupled position, a distance across the rim of the flexible drink cup along the cup short axis is greater than the distance across the recess on the bottom side along the recess short axis.

10. The method of claim 8, wherein the planar island has a flat portion in a first plane and the bottom side of the plate is substantially in a second plane, and wherein the first plane and second plane are parallel and offset from one another by a distance substantially equivalent to a diameter of the rim of the cup.

11. The method of claim 8, wherein the plurality of retaining lugs comprise a portion of the perimeter walls turned to angle toward the middle of the plate.

12. The method of claim 8, wherein the plurality of retaining lugs comprise a portion of the perimeter walls turned to angle toward the middle of the plate and wherein the portion of the wall turned to angle toward the middle terminates in noses adapted to extend beneath the rim.

13. The method of claim 8, wherein a radius of the perimeter walls proximate the short axis is less than a radius of the circular mouth of the flexible cup when the flexible cup is in the coupled position.

14. The method of claim 8, wherein the plurality of lugs form an acute angle K between the lugs and the planar island, and wherein K is between 20 degrees and forty-five degrees.

15. A method of manufacturing a plate having a top side and a bottom side, the plate for releasably coupling to a flexible cup having a rim on a circular mouth, the circular mouth having a mouth diameter, the method comprising:

providing a thermoplastic material; and thermoforming the plate from the thermoplastic material so that the plate comprises:

a circular body having shallow surface walls oriented away from the bottom side to form a container for holding objects on the top side, a planar island formed proximate a middle of the plate, the planar island forming a recess on the bottom side of the plate, the recess on the bottom side of the plate formed with perimeter walls having an oval perimeter and having a long axis and a short axis, wherein the long axis and short axis cross at substantially a ninety degree angle to one another proximate the middle of the plate, a plurality of retaining lugs formed on the perimeter walls proximate to the short axis of the recess, wherein the lugs are sized and configured to extend beneath the rim of the cup when the cup is in a coupled position, and wherein the perimeter walls further comprises:

a first portion of the perimeter walls at one end of the long axis of the recess, wherein the first portion includes the perimeter wall extending outwardly from the middle of the plate and thereby forming a first expansion zone on the bottom side, a second portion of the perimeter walls at the other end of the long axis of the recess, wherein the second portion includes the perimeter wall extending outward from the middle of the plate and thereby forming a second expansion zone on the bottom side, and wherein the first expansion zone and second expansion zone are sized and configured to receive portions of the rim of the cup when the cup is placed in a squeezed position for loading.

16. The method of claim 15, wherein the planar island has a flat portion in a first plane and the bottom side of the plate is substantially in a second plane, and wherein the first plane and second plane are parallel and offset from one another by a distance substantially equivalent to a diameter of the rim of the cup.

17. The method of claim 15, wherein the plurality of retaining lugs comprise a portion of the perimeter walls turned to angle toward the middle of the plate.

18. The method of claim 15, wherein the plurality of retaining lugs comprise a portion of the perimeter walls turned to angle toward the middle of the plate and wherein the portion of the wall turned to angle toward the middle terminates in noses adapted to extend beneath the rim.

19. The method of claim 15, wherein a radius of the perimeter walls proximate the short axis is less than a radius of the circular mouth of the flexible cup when the flexible cup is in the coupled position.

20. The method of claim 15, wherein the plurality of lugs form an acute angle K between the lugs and the planar island, and wherein K is between 20 degrees and forty-five degrees.

21. A plate having a top side and a bottom side, the plate for releasably coupling to a flexible cup having a rim on a circular mouth, the circular mouth having a mouth diameter, the plate comprising:

a body having shallow side walls oriented away from the bottom side to form a container for holding objects on the top side;

perimeter walls forming an ovate perimeter on the bottom side, wherein the perimeter walls surround the perimeter;

at least two retaining lugs formed on the bottom side and extending from the bottom side, wherein the at least two retaining lugs are spaced from one another and are sized and configured to extend beneath the rim of the cup when the cup is in a coupled position, and wherein the at least two retaining lugs are formed by portions of the perimeter walls; and wherein the at least two retaining lugs extend only around a portion of the rim of the flexible cup when in the coupled position to releasably couple the cup and to provide expansion space for a portion of the cup when in a squeezed position.

* * * * *